US005590979A

United States Patent [19]

Sullivan et al.

[11] Patent Number: 5,590,979

[45] Date of Patent: Jan. 7, 1997

[54] FLEXIBLE PIPE DIFFUSER AND METHOD OF USING THE SAME

[75] Inventors: Patrick K. Sullivan, Honolulu; Dayananda Vithanage, Kaneohe; Warren E. Bucher, Mililani, all of Hi.

[73] Assignee: Oceanit Laboratories, Inc., Honolulu, Hi.

[21] Appl. No.: 381,492

[22] Filed: Jan. 31, 1995

[51] Int. Cl.[6] ..... E02B 8/02; E02B 11/00

[52] U.S. Cl. ..... 405/36; 405/52; 405/74; 210/170

[58] Field of Search ..... 405/60, 63, 64, 405/72, 36, 52, 74, 53; 210/448, 459, 497.01, 500.1, 747, 242.1, 170

[56] References Cited

U.S. PATENT DOCUMENTS

| | | | |
|---|---|---|---|
| 3,839,870 | 10/1974 | Ryan | 405/64 |
| 4,008,155 | 2/1977 | Castell | 210/242.1 |
| 4,298,471 | 11/1981 | Dunkers . | |
| 4,377,477 | 3/1983 | Dunkers . | |
| 4,457,842 | 7/1984 | Bereiter . | |
| 4,655,932 | 4/1987 | Roslonski . | |
| 5,071,286 | 12/1991 | Separovich | 405/72 |
| 5,080,783 | 1/1992 | Brown . | |
| 5,267,813 | 12/1993 | Neal | 405/63 |

*Primary Examiner*—Tamara L. Graysay
*Assistant Examiner*—Tara L. Mayo
*Attorney, Agent, or Firm*—James Creighton Wray

[57] ABSTRACT

A flexible pipe diffuser receives dewatering discharge and maintains water quality standards at harbors, lakes and ponds. The diffuser is designed for long-term construction use. It is rugged enough to work under construction conditions but simple enough to be easily assembled and deployed. The flexible pipe diffuser is a fabric tube with minimum 10 feet diameter suspended vertically in the water from a floating platform. Turbid discharge enters the top of the tube and is conducted to the harbor bottom, where sediment is allowed to separate and settle. Floatable materials such as oil and grease separate from dewatering discharge and collect at water surface in the flexible pipe diffuser. The collected floatable materials are removed for disposal by skimmers. The flexible pipe diffuser tube is made of sailcloth and vinyl sewn together. The flexible pipe diffuser has a float platform to which the tube is attached. The float platform is attachable to a pier. The float platform has four polystyrene blocks in a timber frame. The flexible pipe diffuser is moored to the pier with a cable to restrict freedom of motion in the waves. The flotation platform and mooring system keep the diffuser in place beneath the dewatering discharge pipe. A 10 feet diameter diffuser tube handles flow rates up to 1700 gpm with no difficulties when operating at a 30 foot depth.

20 Claims, 2 Drawing Sheets

FLEXIBLE PIPE DIFFUSER AND METHOD OF USING THE SAME

BACKGROUND OF THE INVENTION

To prevent groundwater from flooding coastal construction sites, a dewatering program is sometimes necessary. Systems dealing with dewatering involve the complex process of treating solid and liquid wastes and disposing of them without any detrimental effects to the environment.

A need exists for an inexpensive and safe method of handling dewatering discharge and maintaining water quality standards that is particularly useful at construction sites adjacent to harbors or other coastal sites where the water is at least 30 feet deep. A need exists to control dewatering discharges from coastal construction sites to minimize damage to the marine environment from deposited silt and oil.

SUMMARY OF THE INVENTION

In the present invention, silt is prevented from clouding a body of water when pumping collected water from an excavation or construction site by exhausting a dewatering pump into a flexible pipe diffuser. The diffuser has a rectangular support frame with floats, and a ring stiffened fabric tube which extends downward from the floating frame. Water flows slowly downward through the large stiffened fabric tube while the suspended materials, such as sand, are precipitated through the large bottom of the tube. Because the discharge is slowed and is made to occur a substantial distance below the surface, the body of water is not obscured by inclusions in the outflow.

The flexible pipe diffuser of the present invention fills the longstanding need by conducting silty dewatering discharge from the water surface to the bottom, where it slowly spreads and drops its sediment on the bottom. Since a harbor bottom consists primarily of silty mud, additional silt from the discharge has virtually no impact on the harbor environment.

The flexible pipe diffuser, including flotation platform and fabric tube, is transported to a pier by truck and is assembled on the pier apron. A boom truck is used to lift and hold the platform sections while they are bolted together. The diffuser tube is fastened to the flotation with shackles at twelve places. The entire assembly then is lifted by the boom truck and is placed into the water adjacent to the pier. After the platform is moored to the pier, he bottom of the diffuser tube is anchored by a diver. Four dish or mud anchors on 20-foot lengths of chain are used. In addition, the tube is tied to the pier pilings about 10 feet below the surface with lengths of rope. When the diffuser is moored and anchored, the dewatering discharge pipe is placed to direct flow into the diffuser.

The selection of the diffuser type depends on the location of the water discharge and the nearby water depth, as well as on applicability to future construction dewatering. The flexible pipe diffuser is relatively easy to move along the pier apron, making it adaptable for construction.

A flexible pipe diffuser is used to handle dewatering discharge and to maintain water quality standards at harbors, lakes and ponds. It is designed for long-term construction use. It is rugged enough to work under construction conditions but simple enough to be easily assembled and deployed.

The flexible pipe diffuser is a fabric tube with a minimum of 10 feet diameter suspended vertically in the water from a floating platform. Turbid discharge enters the top of the tube and is conducted to the harbor bottom, where sediment is allowed to separate and settle. Floatable materials such as oil and grease separate from dewatering discharge and collect at water surface in the flexible pipe diffuser. The collected floatable materials are removed for disposal by skimmers.

The flexible pipe diffuser tube is made of sailcloth and vinyl sewn together. The float platform has four polystyrene blocks in a timber frame. The flexible pipe diffuser is moored to the pier with a cable to allow freedom of motion in the waves. The flotation platform and mooring system keep the diffuser in place beneath the dewatering discharge pipe. A 10 feet diameter diffuser tube handles flow rates up to 1700 gpm with no difficulties when operating at a 30 foot depth.

A preferred apparatus for clarifying water has a frame having a vertical opening extending therethrough. Floatable material is connected to the frame for floating the frame in a body of water. An elongated tube extends downward from the frame and has an upper end connected to the frame. An opening in the upper end of the tube receives water.

The elongated tube has an open bottom for flowing water out of the bottom of the tube.

A feed pipe delivers water to the tube. The feed pipe has an outlet positioned above the opening in the upper end of the tube. A cross-sectional size of the feed pipe is relatively small as compared with a cross-sectional size of the tube.

Anchor lines have proximal ends connected to the tube and distal ends remote from the tube. A plurality of anchors are individually connected to distal ends of the anchor lines. The proximal ends of the anchor lines are connected to a lower end of the tube. The entire lower end of the tube is open for freely flowing water out of the tube.

Preferably the tube has a flexible wall for ease in rolling, transporting and assembling. A plurality of stiffened reinforcement members are connected to the tube. Preferably the tube is cylindrical and the reinforcements are rings, which are connected externally to the tube.

The preferred tube has a plurality of loops sewn externally to the tube, and the reinforcing rings are passed through the loops.

An upper portion of the tube is made of an oil-impervious material.

A lower portion of the tube is made of a flexible fabric which is impervious to silt.

The frame in a preferred embodiment is a rectangular frame constructed of wood. Buoyant floats are connected to corners of the frame.

A preferred method of controlling water discharges into bodies of water floats a frame on a body of water. An elongated tube is suspended from the frame, while supporting an upper end of the tube above the surface of the body of water and cloudy water discharge is supplied to an upper end of the tube. Flow is slowed through the tube and water is allowed to slowly flow out an anchored lower end of the tube. Walls of the flexible tube are supported with stiffeners, so that a maximum open lumen is maintained within the tube.

The preferred method prevents egress of floatable liquids from an upper portion of the tube. Floatable liquids are accumulated within an upper portion of the tube. Silt is prevented from flowing outward through walls of the tube. The silt is permitted to flow outward through an open bottom end of the tube.

In a preferred form a kit is packed for shipment to a site to prevent egress of solid and liquid wastes from befouling bodies of water. Frame end and side elements are provided for constructing a frame. Plural floats connect to the frame. A collapsed and rolled elongated, flexible tube has an open upper end for connecting to the frame and has an open lower end. A plurality of shackles are provided to connect the upper end of the tube to the frame. Attachments are provided at the lower end of the tube for connecting the lower end of the tube to anchor changes. A plurality of loops are connected between the upper and lower ends of the tube, and a plurality of stiffeners are provided to mount in the loops and to hold the tube expanded.

An upper portion of the tube is made of vinyl and a lower portion of the tube is made of a lightweight material, for example, Dacron sailcloth.

These and further and other objects and features of the invention are apparent in the disclosure, which includes the above and ongoing written specification, with the claims and the drawings.

DETAILED DESCRIPTION OF THE DRAWINGS

The size of a diffuser depends on several factors, including the quantity of sediment in the discharge, flow of the ambient water, flow rate of the discharge, and desired dilution. Estimates of these factors are made based on experience and measurements.

In one example, the assumed water depth is 30 feet, and a discharge flow rate is 3,000 gallons per minute. The assumed sediment load is 100 mg/l and the current is 0.3 ft/sec. The resulting flexible diffuser tube is 10 feet in diameter, 28 feet long, and gives a dilution factor of 11.

Figure 1:
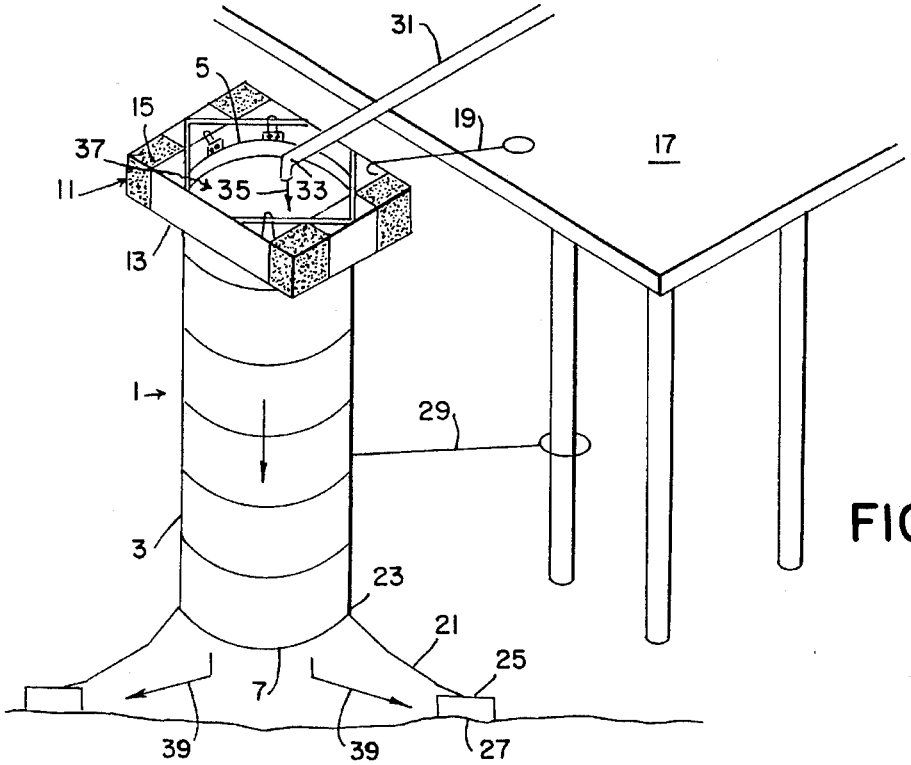
FIG. 1 is a schematic illustration of the flexible pipe diffuser.
Figure 2:
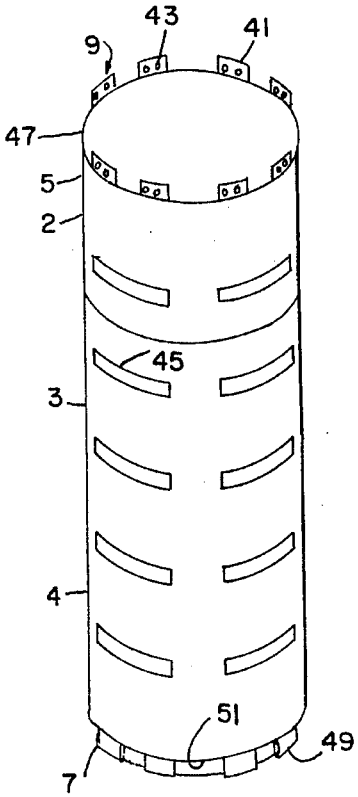
FIG. 2 schematically illustrates the diffuser tube.

The flexible pipe diffuser generally referred to by the numeral 1 is shown schematically in FIG. 1. The structure of the diffuser tube is shown in FIG. 2. The tube 3 is made of two types of fabric. The top section 2 is vinyl so that no floating substance contained in the discharge, such as oil, can leak through the fabric into the water. The remainder, which is the larger lower section 4 of the tube, is Dacron sailcloth, which is relatively impervious to silt or water and is easily obtainable. The tube is sewn together, such as by a sailmaker. The tube is circumferentially reinforced with steel cable to maintain shape and to provide attachment points for anchors and flotation. Middle stiffeners may be butted and bonded plastic pipe hoops. Four anchors are used to position the bottom of the tube and to keep it open. The tube can be connected by rope or cable to pier pilings to keep the tube in position.

Figure 3:
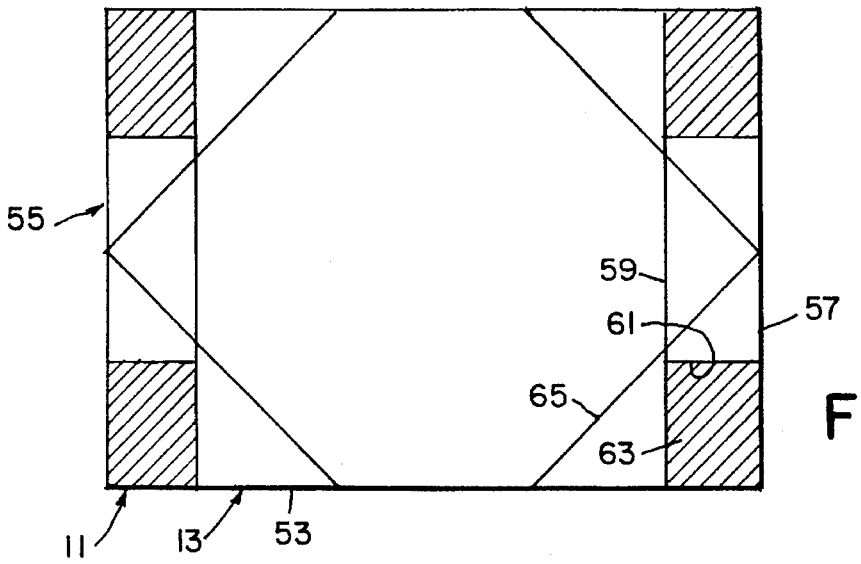
FIG. 3 is a plan view of the float platform.
Figure 4:
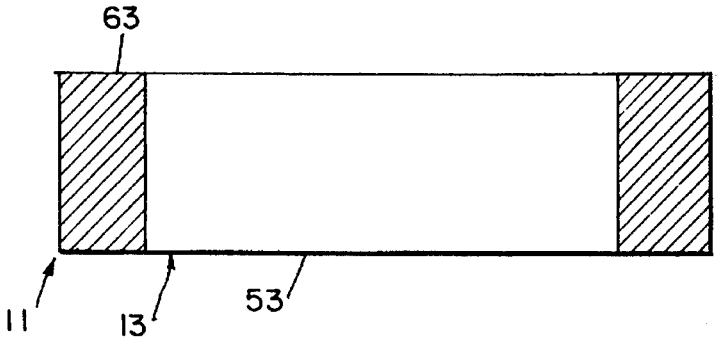
FIG. 4 is a side elevation of the float platform.
Figure 5:
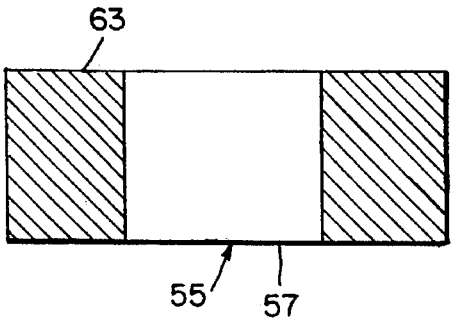
FIG. 5 is an end elevation of the float platform.

The diffuser tube is suspended from a floating platform moored to the pier. A preferred platform is shown in FIGS. 3–5. It is constructed of lumber and contains four large foam floats to provide the required support for the diffuser tube. The platform is constructed in four sections for ease of transportation and is assembled on-site at the pier.

The flotation platform is moored by steel cable to the pier. The system of the invention allows free vertical and rotational movement of the platform with waves, and minimizes stress on the platform.

The flotation platform and diffuser tube are transported to a pier by truck and are assembled on the pier apron. A boom truck is used to lift and hold platform sections while they are bolted together. The diffuser tube is fastened to the flotation with shackles at twelve places. The entire assembly is then lifted by the boom truck and placed into the water adjacent to the pier. The assembly and launching procedure use equipment which is readily available at a construction site. After the platform is moored to the pier, anchors for the diffuser tube are deployed by a diver. Four dish or mud anchors on 20-foot lengths of chain are used. In addition, the tube is tied to the pier pilings about 10 feet below the surface with lengths of rope.

When the diffuser is moored and anchored, the dewatering discharge pipe is placed to direct flow into the diffuser.

Referring to FIG. 1, a flexible-type diffuser of the present invention is generally indicated by the numeral 1. The diffuser has an elongated circular tube 3, with an open upper end 5 and an open lower end 7. The upper end has attachments 9 for attaching the upper end to a floating frame 11, which is made of a wooden construction 13 with plural floats 15. The frame 11 may be secured to the dock 17 with lines 19. Anchor lines 21 have proximal ends 23 attached to the lower end of the tube. Distal ends 25 of the anchor lines are attached to anchors 27. Lines 29 may be connected between mid-points of the elongated tube 3 and pilings of the dock 17. A pipe 31 from a dewatering pump at a construction site has a small opening 33, which is positioned centrally in the upper open end 5 of tube 3. Effluent water 35, which may be cloudy because of contamination with soil, flows into the upper end 5 of the tube 3. Any floatable liquids or solids in the water 35 remain on the upper surface 37 of water within the tube 3. Filtered water 39 is slowly released from the bottom 7 of the elongated tube 3. Because of the slow flow through the tube 3, the clear water 39 is substantially clear. The clear water 39 may carry the suspended silt particles outward without clouding the body of water.

As shown in FIG. 2, the flexible pipe diffuser is preferably made of a fabric tube 3. The open upper end 5 has attachments 9 having flanges 41 with rings 43 for attaching to the float. Plural loops or cable sleeves 45 are sewn to the tube along the length, and are oriented circumferentially for receiving cables for plastic tubes, which form hoops and keep the entire lumen 47 of the tube open. Cables extended through the loops 45 may also be attached to the piers.

A similar cable is extended through loops 49 at the bottom. Openings 51 between the loops provide for anchor cable attachments, as shown in FIG. 1.

As an example, the cable sleeves are attached circumferentially at 6 foot intervals from the bottom. The upper cable sleeve is attached about 4 feet from the top.

The upper 7 feet section 2 of the tube is constructed of an oil and water-impermeable material, for example, vinyl. The lower section 4 may be constructed of a tight polyester fabric or sheet material.

The construction of the floatable frame is shown in FIGS. 3, 4 and 5.

Flat side walls 53 of the floatable frame 11 are constructed as plates of plywood reinforced with 2×4's as the wooden elements of the frame. End walls 55 are constructed as boxes with outer sides 57 and inner sides 59. Corner cavities 61 are filled with four identical foam floats 63. 2×4 cross braces 65 are joined to the side wall sections 53 and end wall sections 57 to form a strong truss. Plural shackles connect the grommets 43 on the flaps 41 at the upper end 5 of the tube 3 to the cross braces 65 and to the end and side walls 57 and 53. The upper end 5 is held above the sure, ace of the body of the water by the floating frame.

Figure 6:
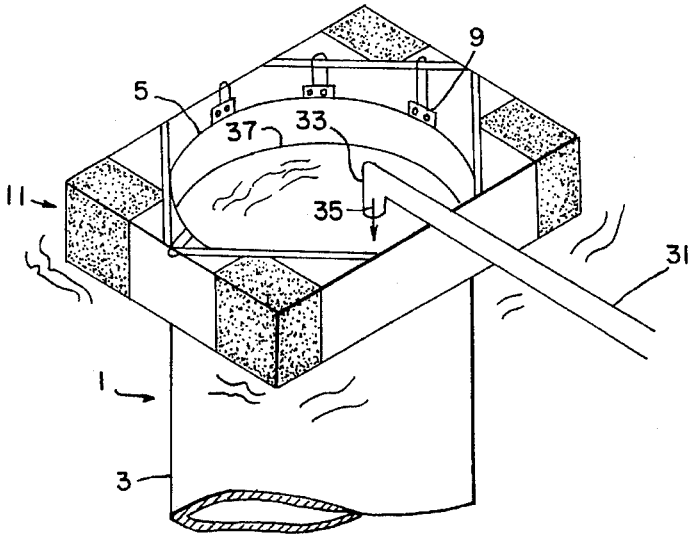
FIG. 6 illustrates the top of a flexible pipe diffuser.

A cable may be threaded through loops at the top 5 of tube 3 and shackles may be attached to the cable between the loops, as shown in FIG. 6, to attach the tip of the tube to the frame. As shown in FIG. 6, the upper end 5 of the tube 3 is supported in the frame. The discharge end 33 of pipe 31 is supported above the open end of the tube. Silt from pipe 33 is carried to the bottom of tube 3 before it is released by the slowly downward flowing water.

While the invention has been described with reference to specific embodiments, modifications and variations of the invention may be constructed without departing from the scope of the invention, which is defined in the following claims.

We claim:

1. Apparatus for clarifying water flowing into a body of water, comprising a frame having a vertical opening extending therethrough, floatable material connected to the frame for floating the frame in a body of water, an elongated collapsible, flexible tube extending downward from the frame and having an upper end connected to the frame, an opening in the upper end of the tube for receiving water, and an opening in a lower end of the tube for releasing water into the body of water.

2. The apparatus of claim 1, wherein the entire lower end of the elongated tube is an open bottom for flowing water out of the bottom of the tube.

3. The apparatus of claim 1, further comprising anchor lines having proximal ends connected to the tube and having distal ends remote from the tube, and further comprising a plurality of anchors individually connected to distal ends of the anchor lines.

4. The apparatus of claim 3, wherein the proximal ends of the anchor lines are connected to a lower end of the tube.

5. The apparatus of claim 4, wherein the entire upper and lower end of the tube are open for freely flowing water into and out of the tube.

6. The apparatus of claim 1, wherein the tube has a flexible wall.

7. The apparatus of claim 6, further comprising a plurality of stiffened reinforcement members connected to the tube.

8. The apparatus of claim 7, wherein the tube is cylindrical and the reinforcements are rings.

9. The apparatus of claim 8, wherein the rings are connected externally to the tube.

10. The apparatus of claim 9, wherein the tube further comprises a plurality of loops sewn externally to the tube, and wherein the reinforcing rings are passed through the loops.

11. The apparatus of claim 9, wherein the frame comprises a rectangular frame constructed of wood, and further comprising buoyant floats connected to corners of the frame.

12. The apparatus of claim 1, wherein an upper portion of the tube is made of an oil-impervious material.

13. The apparatus of claim 12, wherein a lower portion of the tube is made of a flexible fabric which is impervious to silt.

14. Apparatus for clarifying water flowing into a body of water, comprising a frame having a vertical opening extending therethrough, floatable material connected to the frame for floating the frame in a body of water, an elongated tube extending downward from the frame and having an upper end connected to the frame, an opening in the upper end of the tube for receiving water, and an opening in a lower end of the tube for releasing water into the body of the water, further comprising a feed pipe connected to a source of effluent water for delivering effluent water to the tube, the feed pipe having an outlet positioned above the opening in the upper end of the tube for feeding effluent water to the tube from the outlet, and wherein a cross-sectional size of the feed pipe is relatively small as compared with a cross-sectional size of the tube.

15. A method of controlling water discharge into bodies of water, comprising floating a frame on a body of water, suspending an elongated collapsible flexible tube from the frame, supporting an upper end of the tube above the body of water and supplying a discharge to an upper end of the tube, slowing flow through the tube and allowing water to slowly flow out a lower end of the tube.

16. The method of claim 15, further comprising anchoring the lower end of the tube.

17. The method of claim 15, further comprising supporting walls of the flexible tube with stiffeners and maintaining a maximum open lumen within the tube.

18. The method of claim 15, further comprising preventing egress of floatable liquids from an upper portion of the tube, and accumulating floatable liquids within an upper portion of the tube, preventing flow of silt outward through walls of the tube and permitting silt to flow outward through an open bottom end of the tube.

19. A kit for preventing egress of solid and liquid wastes from befouling bodies of water, comprising frame elements for constructing a frame, plural floats for connecting to the frame elements, an elongated, collapsible, flexible tube having an open upper end for connecting to the frame and having an open lower end, a plurality of shackles for connecting the upper end of the tube to the frame and attachments at the lower end of the tube for connecting the lower end of the tube to anchors, and a plurality of loops connected to the tube between the upper and lower ends for attaching stiffeners to the tube.

20. The kit of claim 19, wherein an upper portion of the tube is made of vinyl and a lower portion of the tube is made of a lightweight fabric material.

* * * * *